US005920244A

United States Patent [19]

Kobayashi et al.

[11] Patent Number: 5,920,244

[45] Date of Patent: Jul. 6, 1999

[54] THIN-FILM MULTILAYERED ELECTRODE, HIGH-FREQUENCY RESONATOR, AND HIGH-FREQUENCY TRANSMISSION LINE

[75] Inventors: Masato Kobayashi, Ohmihachiman; Yoshihiko Goto, Shiga-ken; Yukio Yoshino, Ohtsu; Yuzo Katayama, Ohmihachiman, all of Japan

[73] Assignee: Murata Manufacturing Co., Ltd., Japan

[21] Appl. No.: 08/786,691

[22] Filed: Jan. 22, 1997

[30] Foreign Application Priority Data

Jan. 23, 1996 [JP] Japan ..... 8-009061

[51] Int. Cl.[6] ..... H01P 3/00; H01P 7/00

[52] U.S. Cl. ..... 333/219; 333/238; 333/219.1

[58] Field of Search ..... 333/202, 219, 333/219.1, 239, 234, 245, 246, 238

[56] References Cited

U.S. PATENT DOCUMENTS

| | | | |
|---|---|---|---|
| 2,769,148 | 10/1956 | Clogston | 333/236 |
| 2,797,393 | 6/1957 | Clogston | 333/239 |
| 2,831,921 | 4/1958 | Morgan | 178/45 |
| 5,276,412 | 1/1994 | Yoneda et al. | 333/219.1 X |
| 5,428,326 | 6/1995 | Mizan et al. | 333/219.1 |
| 5,470,808 | 11/1995 | Okuyama et al. | 333/219.1 X |

FOREIGN PATENT DOCUMENTS

| | | | |
|---|---|---|---|
| 6156694 | 3/1995 | Australia . | |
| 08-167804 | 6/1996 | Japan . | |
| 95/06336 | 3/1995 | WIPO | 333/219 |

OTHER PUBLICATIONS

Blennemann et al., Novel Microstructures for Low–Distortion Chip–to–chip Interconnects, International Conf. on Adv. in Interconnection and Packaging, SPIE vol. 1389, pp. 215–235, Nov. 1990.

Patent Abstracts of Japan, vol. 96, No. 11, Nov. 29, 1996 & JP 08 191208 A (Murata Mfg. Co., Ltd.) Jul. 23, 1996, abstract.

European Serach Report dated Feb. 25, 1998.

*Primary Examiner*—Seungsook Ham

*Attorney, Agent, or Firm*—Ostrolenk, Faber, Gerb & Soffen, LLP

[57] ABSTRACT

An inexpensive and reliable thin-film multilayered electrode which is formable on a dielectric substrate such as a ceramic substrate. A thin-film multilayered electrode has thin-film conductors and thin-film dielectrics formed by alternately layering on a dielectric substrate with a predetermined dielectric constant. The dielectric constant for each of the thin-film dielectrics is selected such that the electromagnetic field created in the dielectric substrate and the electromagnetic field created in each of the thin-film dielectrics are substantially in phase with each other when the thin-film multilayered electrode is used at a predetermined frequency, and the film thickness of each of the thin-film dielectrics falls between 0.2 μm and 2 μm; and the film thickness of each of the thin-film conductors, other than a thin-film conductor formed most distant from the dielectric substrate, is thinner than the skin depth at the predetermined frequency.

13 Claims, 7 Drawing Sheets

THIN-FILM MULTILAYERED ELECTRODE, HIGH-FREQUENCY RESONATOR, AND HIGH-FREQUENCY TRANSMISSION LINE

BACKGROUND OF THE INVENTION

1. Technical Field of the Invention

This invention relates to a thin-film multilayered electrode of a high-frequency electromagnetic field coupling type formed on a dielectric substrate, a high-frequency resonator employing the same thin-film multilayered electrode and a high-frequency transmission line employing the same thin-film multilayered electrode.

2. Description of Prior and Non-Prior Art

In recent years, there has been a trend toward downsizing of high-frequency resonators and high-frequency transmission lines in electronic components, by using materials possessing a high dielectric constant even in frequency bands as high as microwaves, sub-millimeter waves, and millimeter waves. However, there has been a problem that, if the dielectric constant is very high, downsizing is achieved but the loss of energy will increase in inverse proportion to the cube root of the bulk.

The energy loss in high-frequency resonators or high-frequency transmission lines may be classified as consisting of conductor loss due to the skin effect, and dielectric loss depending on the dielectric material. Recently, dielectric materials with low-loss characteristics, and with high dielectric constants, are being placed into practical use. In high-frequency bands, on the other hand, high-frequency currents concentrate at a conductor surface due to the skin effect so that surface resistance (or so-called skin resistance) increases as the conductor surface is approached, thus increasing the conductor loss (Joule loss). Consequently, the conductor loss, rather than the dielectric loss, has recently become the dominant factor determining the circuit unloaded Q.

Note that the skin effect is a phenomenon, peculiar to transmission of high-frequency signals, wherein high-frequency currents attenuate exponentially inside the conductor as the surface of the conductor becomes more distant. The thin region of the conductor where electric currents flow is referred to as the skin depth, which region is approximately 2.2 $\mu$m at 1 GHz for, e.g. copper. Conventionally, however, the film thickness of conductors used for electrodes of high-frequency application components has been structured sufficiently thicker than the skin depth, in order to prevent radiation loss from being caused by transmission through the electrode. Meanwhile, there have also been problems of surface roughness, etc., of substrates or electrode films in the case where the electrode is formed by the metal-plating or metal-baking technique.

Making the electrode sufficiently thicker than the skin depth has been linked to the reduction of loss. However, a technique has recently been developed of film-forming electrodes precisely on a mirror-like substrate, and it has become feasible to optimize the film thickness for structuring electrodes.

In this situation, the present applicant has proposed in Japanese Patent Application No. H6-310900, etc. published Jun. 25, 1996, a thin-film multilayered electrode in which thin-film conductors and thin-film dielectrics form alternate layers. The thin-film multilayered electrode is formed on a dielectric substrate, and the skin effect is greatly suppressed when utilizing the electrode at a predetermined frequency, by setting the dielectric constant for the dielectric substrate, the dielectric constant and the film thickness for the thin-film dielectrics, and the film thickness for the thin-film conductors to predetermined values, thereby reducing the conductor loss at high frequencies. For example, where Cu thin-film conductors and $SiO_2$ thin-film dielectrics are alternately formed over a sapphire substrate for service at frequencies of around 1 GHz, it is possible to reduce the conductor loss in the thin-film multilayered electrode by setting the film thickness of each thin-film dielectric and each thin-film conductor to values between 1 $\mu$m and 2 $\mu$m.

Although sapphire dielectric substrates are generally and often employed for precise formation of thin-film conductors or thin-film dielectrics as stated above, they are very expensive because they are manufactured by mirror-finish grinding from alumina single crystals. In recent times, there is further strengthening of the demand for downsizing and cost-reduction of high-frequency resonators and high-frequency transmission lines, and the possibility is being considered of forming thin-film multilayered electrodes by employing ceramic substrates, which are higher in dielectric constant than sapphire substrates and lower in cost.

It is noted that in the present specification the "ceramic substrate" referred to is generally a dielectric substrate sintered by thermal treatment of dielectric material in powder form at a predetermined temperature. The dielectric substrate has a number of pores (hereinafter referred to as the "pores" in the specification) existing in the surface thereof because of being manufactured as described above, by thermal sintering treatment of powdered dielectric material at a predetermined temperature.

Due to these pores, a problem has been that where a thin-film multilayered electrode is formed on a ceramic substrate possessing a higher dielectric constant than the sapphire substrate while using thin-film dielectrics with a relatively low dielectric constant, a short-circuit is apt to occur between the thin-film conductors formed above and below the thin-film dielectric in areas inside or around the pores in the ceramic substrate surface, preventing reduction of the conductor loss.

Another problem has been that, where a thin-film multilayered electrode is to be formed on the ceramic substrate, it takes much time and expense to form the thin-film dielectrics, due to the problems of stripping off of the thin-film dielectric and occurrence of cracks in the thin-film dielectric, which have reduced the reliability of the thin-film multilayered electrode.

Therefore, due to these problems in the formation of a thin-film multilayered electrode on a ceramic substrate possessing a higher dielectric constant than the known sapphire substrate, as described above, inexpensive and compact high-frequency resonators with high unloaded Q and high-frequency transmission lines have been unavailable.

It is an advantage of the present invention that it solves the above problems and provides a thin-film multilayered electrode which can be formed on a dielectric substrate such as a ceramic substrate, with high reliability and at low cost and further with reduced conductor loss.

The present invention also advantageously solves the above problems and provides an inexpensive, small high-frequency resonator having increased unloaded Q.

A further advantage of the present invention is to provide a small and inexpensive high-frequency transmission line which has reduced transmission loss.

SUMMARY OF THE INVENTION

A thin-film multilayered electrode according to an aspect of the present invention has thin-film conductors and thin-film dielectrics formed by alternately layering on a dielectric substrate with a predetermined dielectric constant, and is characterized by the following structures and method steps: setting the dielectric constant for each of the thin-film dielectrics such that the electromagnetic field created in the dielectric substrate and the electromagnetic field created in each of the thin-film dielectrics are substantially in phase with one another when the thin-film multilayered electrode is used at a predetermined frequency, and the film thickness of each of the thin-film dielectric falls within a range between 0.2 $\mu$m and 2 $\mu$m; and the film thickness of each of the thin-film conductors other than a thin-film conductor formed most distant from the dielectric substrate is made thinner than the skin depth at the predetermined frequency. This allows formation on the dielectric substrate, thereby providing a thin-film multilayered electrode inexpensively and with high reliability and reduced conductor loss.

According to a second aspect of the invention, in the thin-film multilayered electrode of the first aspect, at least one of the thin-film dielectrics may contain at least one of $Al_2O_3$, $Ta_2O_5$, $SiO_2$, $Si_3N_4$, and MgO. Accordingly, the dielectric constant for each of the thin-film dielectrics is set such that the electromagnetic field created in the dielectric substrate and the electromagnetic field created in each of the thin-film dielectrics are substantially in phase with one another and the film thickness of each of the thin-film dielectrics has a value between 0.2 $\mu$m and 2 $\mu$m.

According to a third aspect of the invention, in the thin-film multilayered electrode of the first or second aspect, at least one of the thin-film dielectrics may contain $Ta_2O_5$ and $SiO_2$, wherein the dielectric constant of the thin-film dielectrics is set by varying the ratio of the $Ta_2O_5$ and the $SiO_2$. Accordingly, the dielectric constant for each of the thin-film dielectrics is set by varying the ratio of the $Ta_2O_5$ and the $SiO_2$ such that the electromagnetic field created in the dielectric substrate and the electromagnetic field created in each of the thin-film dielectrics are substantially in phase with one another and the film thickness of each of the thin-film dielectrics has a value between 0.2 $\mu$m and 2 $\mu$m.

According to a fourth aspect of the invention, in the thin-film multilayered electrode of the first or second aspect, at least one of the thin-film dielectrics may contain $Ta_2O_5$ and $Al_2O_3$, wherein the dielectric constant of the thin-film dielectrics is set by varying the ratio of the $Ta_2O_5$ and the $Al_2O_3$. Accordingly, the dielectric constant for each of the thin-film dielectrics is set by varying the ratio of the $Ta_2O_5$ and the $Al_2O_3$ such that the electromagnetic field created in the dielectric substrate and the electromagnetic field created in each of the thin-film dielectrics are substantially in phase with one another and the film thickness of each of the thin-film dielectrics has a value between 0.2 $\mu$m and 2 $\mu$m.

According to a fifth aspect of the invention, in the thin-film multilayered electrode of the first or second aspect, at least one of the thin-film dielectrics may contain MgO and $SiO_2$, wherein the dielectric constant of the thin-film dielectrics is set by varying the ratio of the MgO and the $SiO_2$. Accordingly, the dielectric constant for each of the thin-film dielectrics is set by varying the ratio of the MgO and the $SiO_2$ such that the electromagnetic field created in the dielectric substrate and the electromagnetic field created in each of the thin-film dielectrics are substantially in phase with one another and the film thickness of each of the thin-film dielectrics has a value between 0.2 $\mu$m and 2 $\mu$m.

According to a sixth aspect of the invention, the thin-film multilayered electrode according to an aspect of the invention may be formed by heat-treatment at a predetermined temperature on a sintered dielectric substrate. Accordingly, a resonator, a filter, a transmission line, or the like which is provided with the above-stated dielectric substrate and the thin-film multilayered electrode can be structured inexpensively.

According to a seventh aspect of the invention, in the thin-film multilayered electrode of the sixth aspect, the thin-film multilayered electrode may be formed on a dielectric substrate based on (Zr, Sn)$TiO_4$. Accordingly, a small-sized resonator, a filter, a transmission line, or the like which is provided with the above-stated dielectric substrate and the thin-film multilayered electrode can be structured inexpensively.

A high-frequency resonator may have two electrodes sandwiching the dielectric substrate, wherein at least one of the two electrodes is characterized by a thin-film multilayered electrode with a predetermined shape according to an aspect of the invention, thereby raising the unloaded Q and reducing the cost and the size.

A high-frequency transmission line may have two electrodes sandwiching the dielectric substrate, wherein at least one of the two electrodes is characterized by a thin-film multilayered electrode with a predetermined width and a predetermined length according to an aspect of the invention, thereby decreasing the transmission loss and reducing the cost and the size.

DETAILED DESCRIPTION OF EMBODIMENTS OF THE INVENTION

Figure 1:
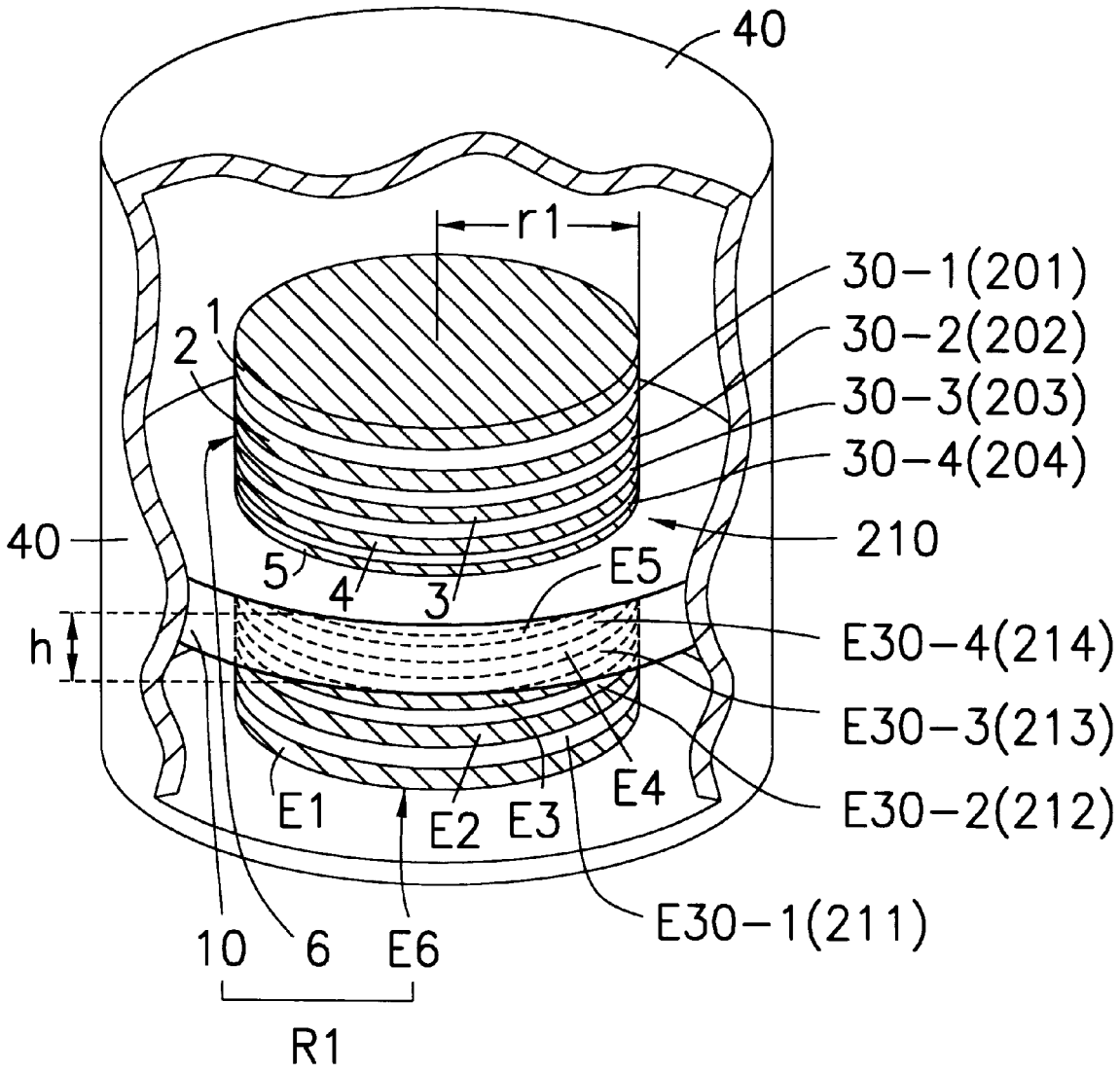
FIG. 1 is a partially-cutaway perspective view of a TM-mode dielectric resonant apparatus of a first embodiment according to the present invention.

Embodiments of the present invention will be described hereinbelow with reference to the drawings. In the attached drawings, the corresponding reference characters are given for corresponding elements.

(First Embodiment)

FIG. 1 is a partially-cutaway perspective view of a TM-mode dielectric resonant apparatus according to a first embodiment according to the present invention. Note that, while FIG. 1 is not a cross sectional view, thin-film conductors 1 to 5, E1 to E5 are emphasized by hatching in order to distinguish them from thin-film dielectrics 30-1 to 30-4, E30-1 to E30-4.

The TM-mode dielectric resonant apparatus of a first embodiment comprises a TM-mode dielectric resonator R1 having a ceramic substrate 10 sandwiched between a thin-film multilayered electrode 6 having a structure wherein thin-film conductors 1 to 5 and thin-film dielectrics 30-1 to 30-4 are layered alternately with one another, and a thin-film multilayered electrode E6 having a structure wherein thin-film conductors E1 to E5 and thin-film dielectrics E30-1 to E30-4 are layered alternately with one another; and a cylindrically-shaped case 40 for enclosing an electromagnetic field created upon exciting the TM-mode dielectric resonator R1 at a resonant frequency, possessing the following characteristics.

(1) The ceramic substrate 10 is comprised of a (Zr, Sn)$TiO_4$ sintered body with a relative dielectric constant $\epsilon m$ =38.

(2) The thin-film dielectrics 30-1 to 30-4, E30-1 to E30-4 are comprised of Ta—Si—O dielectric, wherein the thin-film dielectrics 30-k, E30-k=1,2,3,4 ) have predetermined film thickness values between 0.2 $\mu$m and 2 $\mu$m.

The TM-mode dielectric resonant apparatus of the first embodiment is explained in detail hereinbelow by reference to the drawings. Firstly, an explanation will be given of the structure of the TM-mode dielectric resonant apparatus and the operational principle of the thin-film multilayered electrodes 6, E6 at a resonant frequency for the TM-mode dielectric resonant apparatus, without specifying the dielectric material for the ceramic substrate 10 and the thin-film dielectrics 30-1 to 30-4, and E30-1 to E30-4.

In the TM-mode dielectric resonator R1, the thin-film multilayered electrode 6 is formed on an upper surface of a ceramic substrate 10 by alternately layering circularly-shaped thin-film conductors 1 to 5 each having a predetermined radius r1 and circularly-shaped thin-film dielectrics 30-1 to 30-4 each having the same radius r1, with the thin-film conductor 5 in contact with the upper surface of the ceramic substrate 10. By doing so, four TM-mode dielectric resonators (hereinafter referred to as the sub TM-mode resonators) 201 to 204 are layered, each of which has one thin-film dielectric sandwiched between a pair of thin-film conductors. In FIG. 1, the sub TM-mode resonators are respectively indicated by reference characters in parentheses following those of the thin-film dielectrics 30-1 to 30-4 of the same sub TM-mode resonators. Note that all the resonant frequencies for the sub TM-mode resonators 201 to 204 are set equal to each other.

On the other hand, the thin-film multilayered electrode E6 is formed on a lower surface of the ceramic substrate 10 by alternately layering circular thin-film conductors E1 to E5 each having a predetermined radius r1 and circular thin-film dielectrics E30-1 to E30-4 each having the same radius r1, with the thin-film conductor E5 in contact with the lower surface of the ceramic substrate 10 and opposed to the thin-film conductor 5. By doing so, four TM-mode dielectric resonators 211 to 214 are layered, each of which has one thin-film dielectric sandwiched between a pair of thin-film conductors. Note that all the resonant frequencies for the sub TM-mode resonators 211 to 214 are set equal to each other, and also, the resonant frequency for the sub TM-mode resonators 201 to 204 and the resonant frequency for the sub TM-mode resonators 211 to 214 are set equal.

Furthermore, a TM-mode resonator (hereinafter referred to as the main TM-mode resonator) 210 is structured by sandwiching the ceramic substrate 10 between the thin-film conductor 5 and the thin-film conductor E5. Note that the resonant frequency for the main TM-mode resonator 210 is set equal to the resonant frequency for the sub TM-mode resonators 201 to 204 and the sub TM-mode resonators 211 to 214.

Also, the main TM-mode resonator 210 is satisfied by an open condition on the circumferential plane within the ceramic substrate defined by connection in the thickness direction of the outer peripheral circle of the thin-film conductor 5 and the outer peripheral circle of the thin-film conductor E5. That is, this circumferential plane is of a magnetic wall. Further, the circumferential plane of the thin-film dielectrics 30-1 to 30-4 for the sub TM-mode resonators 201 to 204 and the circumferential plane of the thin-film dielectrics E30-1 to E30-4 for the sub TM-mode resonators 211 to 214 are respectively of magnetic walls satisfied by the open condition.

Particularly, in the TM-mode dielectric resonator of the first embodiment, the film thickness and the relative dielectric constant $\epsilon s$ of each of the thin-film dielectrics 30-1 to 30-4 are set such that the electromagnetic field created when the main TM-mode resonator 210 is excited at the aforesaid resonant frequency and the electromagnetic field created when each of the sub TM-mode resonators 201 to 204 is excited at the aforesaid resonant frequency become substantially in the same phase. And further, the film thickness and the relative dielectric constant $\epsilon s$ of each the thin-film dielectrics E30-1 to E30-4 are set such that the electromagnetic field of the main TM-mode resonator 210 and the electromagnetic field, created when each of the sub TM-mode resonators 211 to 214 is excited at the aforesaid resonant frequency, become substantially in the same phase.

Furthermore, by setting the conductor film thickness of each of the thin-film conductors 2 to 5 to a predetermined thickness which is thinner than the resonant-frequency skin depth $\delta 0$, and increasing the thickness as the layer is positioned higher, the adjacent magnetic fields are coupled to each other respectively between the main TM-mode resonator 210 and the sub TM-mode resonator 204, the sub TM-mode resonator 204 and the sub TM-mode resonator 203, the sub TM-mode resonator 203 and the sub TM-mode resonator 202, and the sub TM-mode resonator 202 and the sub TM-mode resonator 201. By doing so, the resonant energy of the main TM-mode resonator 210 is partly transferred to the sub TM-mode resonators 204, 203, 202, and 201, so that the thin-film conductors 1 to 5 are respectively given a high-frequency current flowing therein, greatly suppressing the skin effect due to the high frequency.

Also, by setting similarly the conductor film thickness of each of the thin-film conductors E2 to E5, the resonant energy of the main TM-mode resonator 210 is partly transferred to the sub TM-mode resonators 214, 213, 212, and 211, so that the thin-film conductors E1 to E5 are respectively given a high-frequency current flowing therein, greatly suppressing the skin effect due to the high frequency.

That is, the thin-film multilayered electrodes 6, E6 are respectively thin-film multilayered electrodes of the high-frequency electromagnetic field coupling type.

Further, the thin-film conductors 1, E1 are formed such that the conductor film thickness of each of the thin-film conductors 1, E1 is $\pi/2$ times the aforesaid resonant-frequency skin depth $\delta 0$, at which film thickness the sum of the conductor loss and the radiation loss for the thin-film conductors 1, E1 becomes minimum.

Also, the TM-mode dielectric resonator R1 is fixed within a cylindrically-shaped case 40 having opposite top and bottom surfaces and an inner diameter which is the same as an outer diameter of the ceramic substrate 10, such that the ceramic substrate 10 at its lateral faces is in contact with the inner peripheral surface of the case 40. The top face of the thin-film multilayered electrode 6 is spaced from the top surface of the case 40 by a predetermined distance, while the bottom face of the thin-film multilayered electrode E6 and the bottom surface of the case 40 are placed in electrically conductive contact with each other. In the above manner, the TM-mode dielectric resonant apparatus of the first embodiment is structured.

The operation of the thin-film multilayered electrodes 6, E6, when the TM-mode dielectric resonant apparatus of the first embodiment is in a resonant state, is explained hereinbelow.

When the main TM-mode resonator 210 is excited by high-frequency signals with a resonant frequency, the TM-mode resonator 210 resonates in a TM mode, as is known. On this occasion, the thin-film conductor 5 located at the lowest layer of the thin-film multilayered electrode 6 transmits part of resonant energy of the main TM-mode resonator 210 into the upper thin-film conductor 4. Each of the thin-film conductors 1 to 4 transmits part of resonant energy coming from the lower thin-film conductor into the upper thin-film conductor. This brings the sub TM-mode resonators 201 to 204 into resonance at the same frequency as the main TM-mode resonator 210, wherein two facing and opposite high-frequency currents (hereinafter referred to as the facing two high-frequency currents) are flowing respectively around the upper and lower surfaces of the conductor thin films 1 to 5. That is, since the film thickness of each of the thin-film conductors 2 to 5 is thinner than the skin depth 60, the facing two high-frequency currents are in interference and partly offset by each other. On the other hand, each of the thin-film dielectrics 30-1 to 30-4 has a displacement current caused by the electromagnetic field, causing high frequency currents in the surfaces of the adjacent thin-film conductors. Further, the film thickness of each of the thin-film dielectrics 30-1 to 30-4 is configured such that the electromagnetic fields for main TM-mode resonator 210 and the sub TM-resonator 201 to 204 are substantially in the same phase, so that the high-frequency currents flowing in the thin-film conductors 1 to 5 are substantially in phase with one another. By this, the high-frequency currents flowing in each of the thin-film conductors 1 to 5 effectively increase the skin depth.

Also, in the first embodiment, the conductor film thickness of each respective thin-film conductor is set thicker as the height of the thin-film conductor increases, so that the amplitude of the high-frequency current increases as the height of the thin-film conductor increases. The thicknesses are set in such a manner that the skin depth is effectively increased maximally. Further, the thickness of the uppermost layered thin-film conductor 1 is set at $\pi/2$ times the skin depth, which is thicker than the skin depth, so that it operates to effectively increase the skin depth of the thin-film conductor per se while shielding the resonant energy so it is not radiated into free space. In this manner, since the conductor loss for the thin-film multilayered electrodes 6, E6 can be reduced to a small amount, as compared with the case of an electrode formed with only one conductor layer, it is possible to realize, in principle, a TM-mode dielectric resonant apparatus with significantly larger unloaded Q.

As stated above, in the TM-mode dielectric resonator R1, in order to reduce the conductor loss of the thin-film multilayered electrode 6, it is effective to set the relative dielectric constant $\epsilon m$ of the ceramic substrate 10 and the relative dielectric constant $\epsilon s$ of each of the thin-film dielectrics 30-k (k=1, 2, 3, 4), and the film thickness of each of the thin-film dielectrics 30-k, such that the electromagnetic field created in the ceramic substrate 10 and the electromagnetic field created in the thin-film dielectric 30-k are substantially in phase with each other at the resonant frequency of the TM-mode dielectric resonator R1, i.e., at the intended frequency of use.

Figure 2:
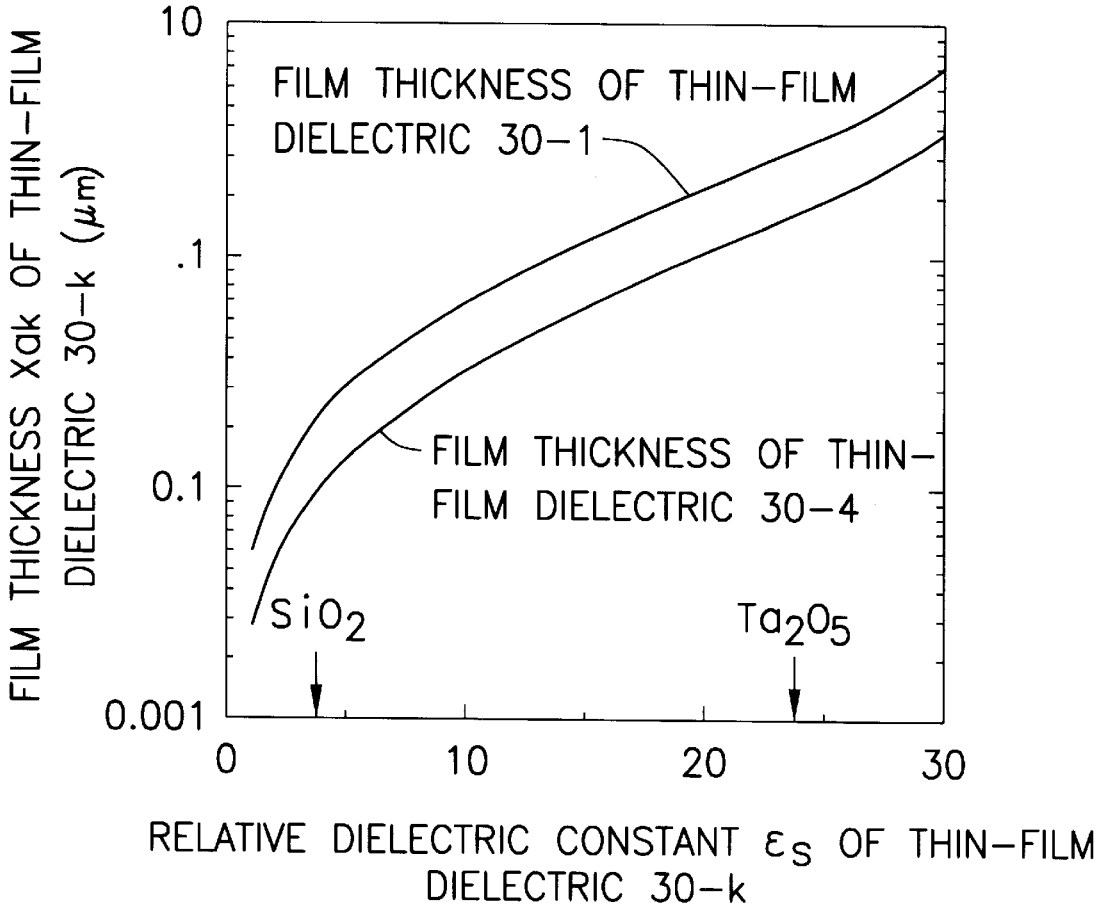
FIG. 2 is a graph showing the thickness xak of the thin-film dielectric 30-k against the relative dielectric constant $\epsilon s$ of the thin-film dielectric 30-k when the electromagnetic field created in the ceramic substrate 10 and the electromagnetic field created in each of the thin-film dielectrics are substantially in the same phase.

According to the result of our considerations, the film thickness xak, as set forth graphically in FIG. 2, which has been set such that the electromagnetic field created in the ceramic substrate 10 and the electromagnetic field created in each thin-film dielectric 30-k are substantially in phase with each other, is proportional to the reciprocal of $\{(\epsilon m/\epsilon s)-1\}$ (see Japanese Patent Application No. H6-310900 for example). That is, if the relative dielectric constant $\epsilon m$ for the ceramic substrate 10 is made large, the film thickness xak becomes small, whereas if the relative dielectric constant $\epsilon m$ for the ceramic substrate 10 is made small, the film thickness xak becomes large. If the relative dielectric constant $\epsilon s$ of a thin-film dielectric 30-k is decreased, the film thickness xak becomes smaller, whereas if the relative dielectric constant $\epsilon s$ of a thin-film dielectric 30-k is increased, the film thickness xak becomes larger. This is true similarly for the thin-film multilayered electrode E6.

Consequently, in the first embodiment of a TM-mode dielectric resonant apparatus, it is of importance to set the relative dielectric constant $\epsilon m$ for the ceramic substrate 10 and the relative dielectric constant es for each thin-film dielectric 30-k, E30-k in order to reduce the conductor loss in the thin-film multilayered electrodes 6, E6. In other words, in order to decrease the conductor loss in the thin-film multilayered electrode 6, E6, the selection of materials employed for the ceramic substrate 10 and the thin-film dielectrics 30-k, E30-k is an important factor.

Therefore, the dielectric materials employed for the ceramic substrate 10 and the thin-film dielectrics 30-1 to 30-4, E30-1 to E30-4 will next be described. Note that in the first embodiment, the resonant frequency f0 of the TM-mode dielectric resonator R1 is set at 950 MHz, for example. Consequently, the service frequency of the thin-film multilayered electrode 6 is 950 MHz.

In the first embodiment, the ceramic substrate 10 is formed by preparing a powder material so as to meet the chemical formula $(Zr, Sn)TiO_4$ which material is formed into a predetermined shape and thereafter sintered at a temperature of 1350° C. and then cut into a predetermined thickness h, followed by being ground at upper and lower surfaces. Note that the ceramic substrate 10 possesses a relative dielectric constant $\epsilon m$=38. Also, as is generally well known, there are a number of pores in the surface of the ceramic substrate 10 thus formed.

The present inventors have first determined by calculation the effective film thickness xak of the thin-film dielectric 30-k for a given relative dielectric constant $\epsilon s$ of the thin-film dielectric 30-k in order to make the electromagnetic field created in the ceramic substrate 10 and the electromagnetic field created in the thin-film dielectric 30-k substantially in phase with each other at the resonant frequency f0=950 MHz of the TM-mode dielectric resonator R1. The results as to the thin-film dielectric 30-1 and the thin-film dielectric 30-4 are shown in a graph of FIG. 2. Note that the film thickness xak of the thin-film dielectric 30-2 and the thin-film dielectric 30-3, while not shown in FIG. 2, will take intermediate values between those of the thin-film dielectric 30-1 and the thin-film dielectric 30-4.

The present inventors have considered forming a thin-film multilayered electrode 6 using a thin-film dielectric 30-k formed of silicon dioxide $SiO_2$ on the ceramic substrate 10. As shown in FIG. 2, it was found, as a result of calculation using the relative dielectric constant $\epsilon m=38$ for the ceramic substrate 10 and the relative dielectric constant $\epsilon s=4$ for the $SiO_2$, that the conductor loss can be reduced if the film thickness xak of each of the thin-film dielectrics 30-k is set at a predetermined value of between 0.1 $\mu$m and 0.2 $\mu$m. It was however found that, if such a thin-film dielectric 30-k with this thickness is used in actual formation of a thin-film multilayered electrode 6 on the top surface of the ceramic substrate 10, short-circuits occur adjacent to the pores present on the top surface of the ceramic substrate 10 and the edge portion thereof, between the adjacent thin-film conductors k, k+1 via the thin-film dielectric 30-k, making reduction of the conductor loss impossible.

The short-circuits between the adjacent thin-film conductors k and k+1 at and inside pores are presumed to occur for the following reasons. First, a thin-film conductor 5 is formed over the top surface of a ceramic substrate 10, e.g., by the sputtering method. On this occasion, the thin-film conductor 5 is formed conforming to hollowed faces of pores existing in the surface of the ceramic substrate 10. That is, the thin-film conductor 5 has pores present in a top surface thereof, similarly to the surface of the ceramic substrate 10. If a thin-film dielectric 30-4 is formed by for example sputtering over the porous surface of the thin-film conductor 5, there exist thinly-formed portions and thickly-formed portions of the thin-film dielectric 30-4 on the surfaces inside the pores. That is, the surfaces inside the pores may be thought of as a combination of different surfaces assuming various angles relative to the thickness direction of the ceramic substrate 10. The thin-film dielectric 30-k is formed by the sputtering technique wherein dielectric material of a particulate or molecular form is deposited in the thickness direction of the ceramic substrate 10. Consequently, on the surface of the pore, the thin-film dielectric 30-4 is formed to a predetermined thickness on a part of the surface perpendicular to the thickness of the ceramic substrate 10, while it is formed thinner than the predetermined thickness on a part of the surface not perpendicular to the thickness direction of the ceramic substrate 10.

Consequently, if $SiO_2$ for example is used to form the thin-film dielectric 30-4 to the thickness xa4 of 0.1 $\mu$m, the surface inside the pore that is not perpendicular to the thickness direction of the ceramic substrate will have a thickness that is less than the predetermined thickness 0.1 $\mu$m. With such a thin-film dielectric 30-4 it is presumed that the inside surface of the pore cannot completely be covered by the formation of the thin-film dielectric 30-4. As a result, it seems that portions of the thin-film conductor 5 are exposed inside the pore and the thin-film conductor 5 is thereby brought into short-circuit with the thin-film conductor 4 formed over the thin-film dielectric 30-4. This is true similarly for the thin-film dielectrics 30-1 to 30-3 and the thin-film conductors 1 to 4.

It was confirmed by the results of our considerations that the film thickness of the thin-film dielectric is further thinner at an edge of the pore.

Accordingly it seems that the thin-film conductor 5 is liable to be exposed at the surface of a pore and short-circuited to a thin-film conductor 4 formed over a thin-film dielectric at the surface of the pore.

As a result of further considerations in detail on these matters, it was revealed that, where a thin-film multilayered electrode 6 is formed over a ceramic substrate 10 having pores in the surface thereof, the short-circuit between the thin-film conductors k and k+1 which are separated by the thin-film dielectric 30-k can be prevented, by setting the film thickness of the thin-film dielectric 30-k to a value greater than 0.2 $\mu$m. Therefore, it is preferred that the film thickness xak of the thin-film dielectric 30-k be set greater than 0.2 $\mu$m, for a thin-film multilayered electrode 6 formed over the ceramic substrate 10.

The present inventors then tried to form a thin-film multilayered electrode 6 on the ceramic substrate 10 using tantalum oxide $Ta_2O_5$. It was found in this case that, if the film thickness xak of each thin-film dielectric 30-k is set to a predetermined value of between 2 $\mu$m and 3 $\mu$m, the conductor loss can be reduced and short-circuit does not occur between the thin-film conductors k and k+1 at the inside and the edge of the pore present in the upper surface of the ceramic substrate 10 as shown in FIG. 2. In a thin-film dielectric 30-k with such thickness, however, it takes long time to form a film. Moreover, there may be cases where the thin-film dielectric 30-k has cracks or is easy to peel off, or where the ceramic substrate 10 is warped, so that if the thin-film multilayered electrode 6 is used for a long term the conductor loss increases as time elapses, etc. impairing reliability.

The reason for this may be explained as follows. That is, in general, there necessarily exist internal stresses $\sigma$ that may result from lattice defects in a thin-film dielectric 30-k formed through the use of the sputtering or vacuum evaporation technique. Note that the internal stress a is a force acted on by the dielectrics opposite to each other through an arbitrary unit-area surface defined inside the thin-film dielectric 30-k, being represented by a pressure unit such as Pa. The total stress S in the thin-film dielectric 30-k is proportional to the product of the film thickness xak of the thin-film dielectric 30-k and the internal stress $\sigma$. That is, the total stress S is expressed by Equation 1 given below. Note that the total stress S corresponds to surface tension created in a surface layer wherein the thin-film dielectric 30-k is regarded as one surface layer, and is represented by a unit N/m.

(Equation 1)

$$S \quad \sigma \times Xak$$

As stated above, the total stress S for the thin-film dielectric 30-k is proportional to the film thickness xak of the thin-film dielectric 30-k. That is, the total stress S for the thin-film dielectric 30-k increases as the thickness xak of the thin-film dielectric 30-k increases. As a consequence, it can be considered that, when the thickness xak of the thin-film dielectric increases, the total stress S becomes large, causing cracks in the thin-film dielectric 30-k or peeling off of the thin-film dielectric 30-k or warping in the ceramic substrate 10. The present inventors have confirmed, as a result of further detailed considerations, that there is no occurrence of the above-stated phenomenon when the film thickness xak of the thin-film dielectric 30-k is smaller than 2 $\mu$m. Therefore, it is preferred to set the film thickness xak of the thin-film dielectric 30-k smaller than 2 $\mu$m in the thin-film multilayered electrode 6 formed over the ceramic substrate 10.

From the above, the present inventors have obtained the following conclusions:

(1) Where a thin-film multilayered electrode 6 is formed on the ceramic substrate 10 having pores present in the surface thereof, if the film thickness of the thin-film dielectric 30-k is set preferably to a value of between 0.2 $\mu$m and 2 $\mu$m, short-circuits between the thin-film conductors k and k+1 which are separated by thin-film dielectric 30-k, cracks in the thin-film dielectrics 30-k, and warping of the ceramic substrate 10 can be prevented.

(2) Where the thin-film multilayered electrode 6, formed on the substrate 10 with a relative dielectric constant $\epsilon m=38$, is used around a frequency of 950 MHz, if the relative dielectric constant $\epsilon s$ is set in a range of between 4 and 23, the film thickness xak of the thin-film dielectric 30-k can be set to a value of between 0.2 $\mu$m and 2 $\mu$m in order to reduce the conductor loss in the thin-film multilayered electrode 6 to a low value.

Under such circumstances, the present inventors have sought a dielectric material which meets the above condition (2). As a result, Ta—Si—O dielectric was found. Note that in the present specification Ti—Si—O dielectric refers to a material that is comprised of $Ta_2O_5$ and $SiO_2$ wherein the relative dielectric constant for the same dielectric material can be varied by varying the composition ratio of $Ta_2O_5$ and $SiO_2$.

Figure 3:
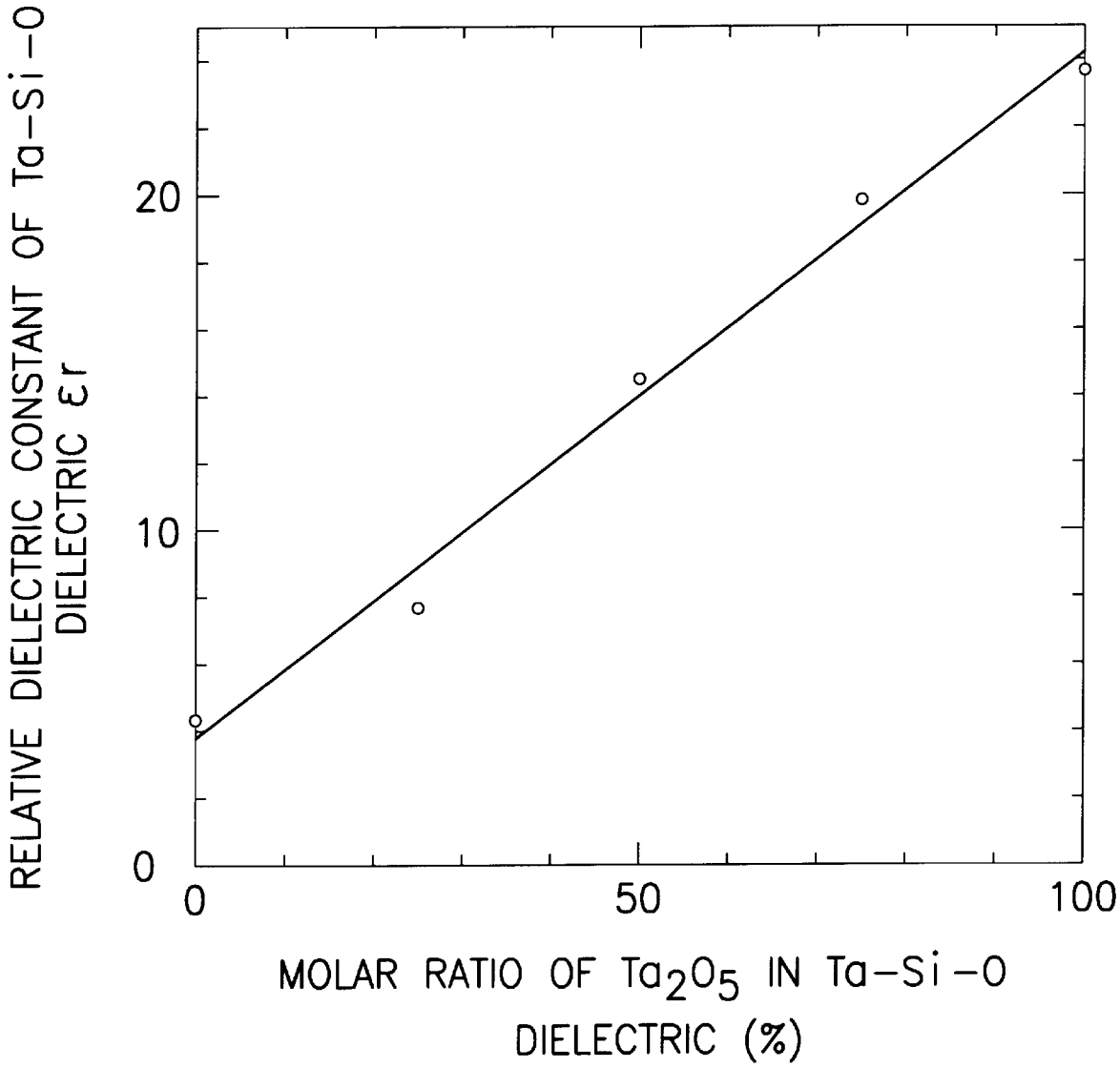
FIG. 3 is a graph showing the relative dielectric constant $\epsilon r$ against the molar ratio of $Ta_2O_5$ in Ta—Si—O dielectric.

FIG. 3 is a graph representing the relative dielectric constant $\epsilon r$ of Ta—Si—O dielectric versus the molar ratio of $Ta_2O_5$ in Ta—Si—O dielectric. As clear from the graph of FIG. 3, it will be understood that the relative dielectric constant $\epsilon r$ of Ta—Si—O dielectric varies almost linearly as the molar ratio of the $Ta_2O_5$ varies from 0 to 100%. That is, the relative dielectric constant $\epsilon r$ of Ta—Si—O dielectric can be set to a predetermined value between 4 and 23 by varying the molar ratio of the $Ta_2O_5$ and $SiO_2$. Consequently, in the first embodiment, the relative dielectric constant $\epsilon s$ of the thin-film dielectric 30-k can be set to a predetermined value of between 4 and 23 by changing the molar ratio of the $Ta_2O_5$ and $SiO_2$, and the film thickness xak of the thin-film dielectric 30-k can be set to a value of between 0.2 $\mu$m and 2 $\mu$m.

Although the above explanation is based on the thin-film multilayered electrode 6, it is also true for the thin-film multilayered electrode E6. Consequently, in the first embodiment, the thin-film dielectrics 30-k, E30-k were also formed by using Ta—Si—O dielectric, and the film thickness xak, xaek for the thin-film dielectric 30-k, E30-k were between 0.2 $\mu$m and 2 $\mu$m.

According to the first embodiment TM-mode dielectric resonator R1 as above, the skin depth can effectively be increased by the provision of the thin-film multilayered electrodes 6, E6 to thereby greatly reduce the conductor loss and the surface resistance as compared with the conventional one. This allows realization of a TM-mode dielectric resonator with a significantly larger unloaded Q.

In the TM-mode dielectric resonator of the first embodiment, the provision of the TM-mode dielectric resonator R1 allows an increase of the unloaded Q, and the provision of the cavity 40 provides a reduction of the radiation loss and a further increase of the unloaded Q as well as preventing coupling of the electromagnetic field of the TM-mode dielectric resonator R1 to the electromagnetic field of an external circuit, thereby stabilizing the resonant frequency.

With the thin-film multilayered electrodes 6, E6 of the first embodiment, since the thin-film dielectrics 30-k, E30-k are formed by using Ta—Si—O dielectric, each film thickness xak, xaek of the thin-film dielectrics 30-k, E30-k can be set to a value of between 0.2 $\mu$m and 2 $\mu$m. Therefore, short-circuits between the thin-film conductors can be prevented and the conductor loss in the thin-film multilayered electrode 6, E6 can be reduced, forming highly-reliable thin-film multilayered electrodes 6, E6.

In the TM-mode dielectric resonator of the first embodiment, Ta—Si—O dielectric employed for the thin-film dielectrics 30-k, E30-k has a relative dielectric constant $\epsilon r$ which can be set to a predetermined value of between 4 and 23 by varying the composition ratio of $Ta_2O_5$ and $SiO_2$. By this, the relative dielectric constant $\epsilon s$ of the thin-film dielectric 30-k, E30-k can be set such that the electromagnetic field created in the ceramic substrate 10 and the electromagnetic field created in the thin-film dielectric 30-k, E30-k are substantially in phase with each other when each film thickness xak, xaek of the thin-film dielectric 30-k, E30-k is between 0.2 $\mu$m and 2 $\mu$m.

(Second Embodiment)

Figure 4:
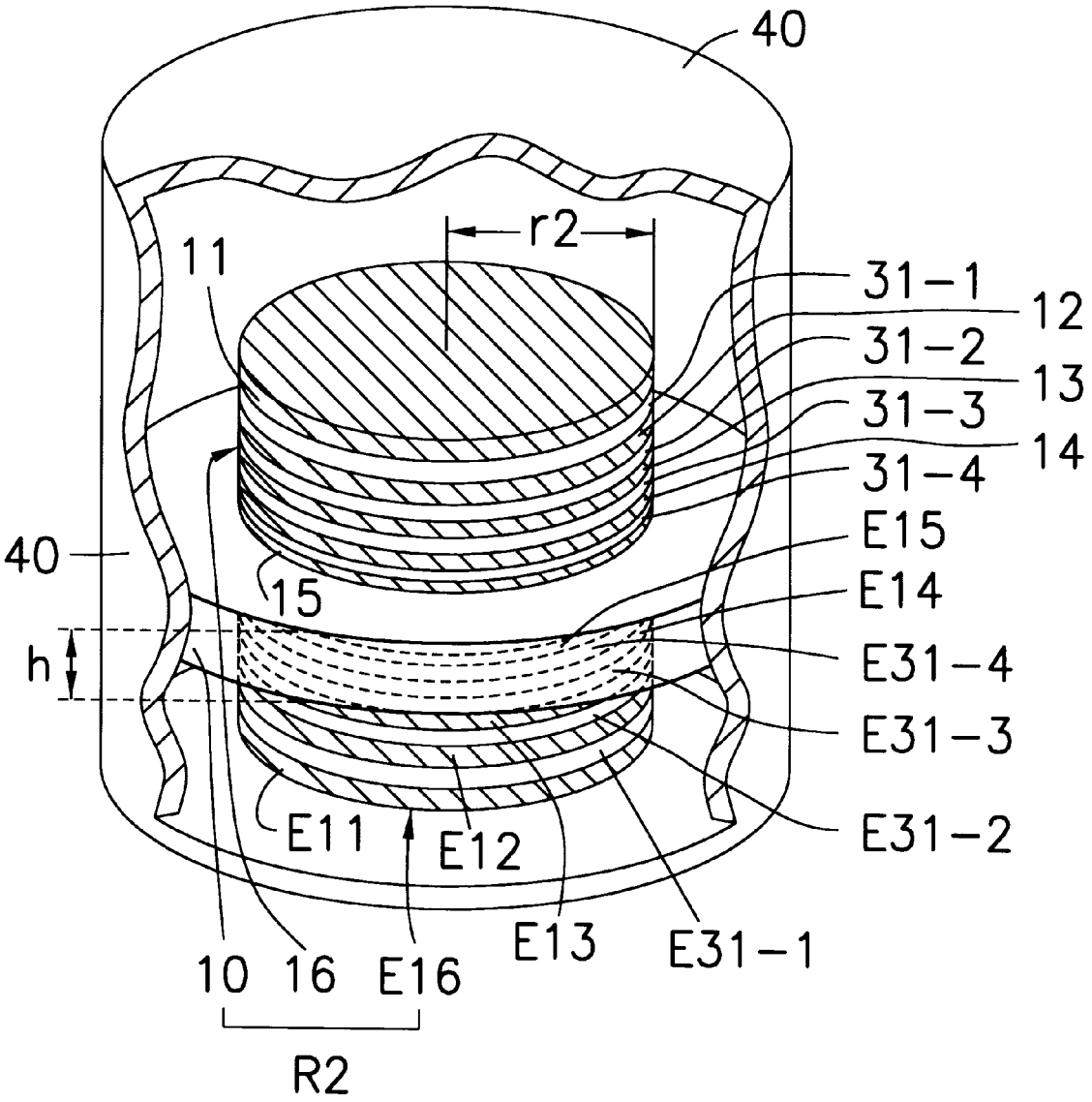
FIG. 4 is a partially-cutaway perspective view of a TM-mode dielectric resonant apparatus of a second embodiment according to the present invention.

FIG. 4 is a partially-cutaway perspective view of a TM-mode dielectric resonator of a second embodiment according to the present invention. Note that, while FIG. 4 is not a cross sectional view, thin-film conductors 11 to 15, E11 to E15 are shown by hatching in order to distinguish from thin-film dielectrics 31-1 to 31-4, E31-1 to E31-4. In FIG. 4, the same elements as those in FIG. 1 are denoted by the same reference characters.

The TM-mode dielectric resonant apparatus of the second embodiment is different from the TM-mode dielectric resonant apparatus of FIG. 1 in the following points.

(1) The thicknesses of the thin-film dielectrics 31-k, E31-k are all the same, and the thicknesses of the thin-film conductors 11 to 15, E11 to E15 are all the same.

(2) The thin-film dielectrics 31-k, E31-k are formed of Al—Ta—O dielectric, and each film thickness of the thin-film dielectrics 31-k, E31-k is set to a predetermined value in a range of between 0.2 $\mu$m and 2 $\mu$m.

Note that in the second embodiment the resonant frequency f0 of the TM-mode dielectric resonator R2 is set at 2.6 GHz by setting the radius r2 of the thin-film multilayered electrodes 16, E16 to a predetermined value.

The TM-mode dielectric resonant apparatus of the second embodiment is explained hereinbelow with reference to the drawings. First, in the second embodiment, the dielectric film thickness and the conductor film thickness are set, with each dielectric film thickness being the same and with each conductor film thickness of the thin-film conductors 11 to 15, E11 to E15 being the same, such that the electromagnetic field created in the ceramic substrate 10 and the electromagnetic field created in the thin-film dielectrics 31-k, E31-k are substantially in phase with each other. As determined by the present inventors, it was confirmed that although the thin-film multilayered electrode 16, E16 thus constructed has a greater conductor loss as compared with the thin-film multilayered electrode 6, E6, the conductor loss can be significantly reduced as compared with a single-layered electrode which is thicker than the skin depth.

The dielectric material employed for the thin-film dielectric 31-1 to 31-4, E31-1 to E31-4 of the second embodiment will now be described. Note that the ceramic substrate 10 is comprised by a sintered body which is formed through the formation of a powder material being prepared to meet the chemical formula $(Zr, Sn)TiO_4$ into a predetermined shape and thereafter sintered at a temperature of 1350° C. similarly to the first embodiment, which substrate possesses a relative dielectric constant $\epsilon m=38$. Also, in the second embodiment, the resonant frequency f0 for the TM-mode dielectric resonator R2 is set at 2.6 GHz so that the service frequency of the thin-film dielectric multilayered electrodes 16, E16 is 2.6 GHz.

Figure 5:
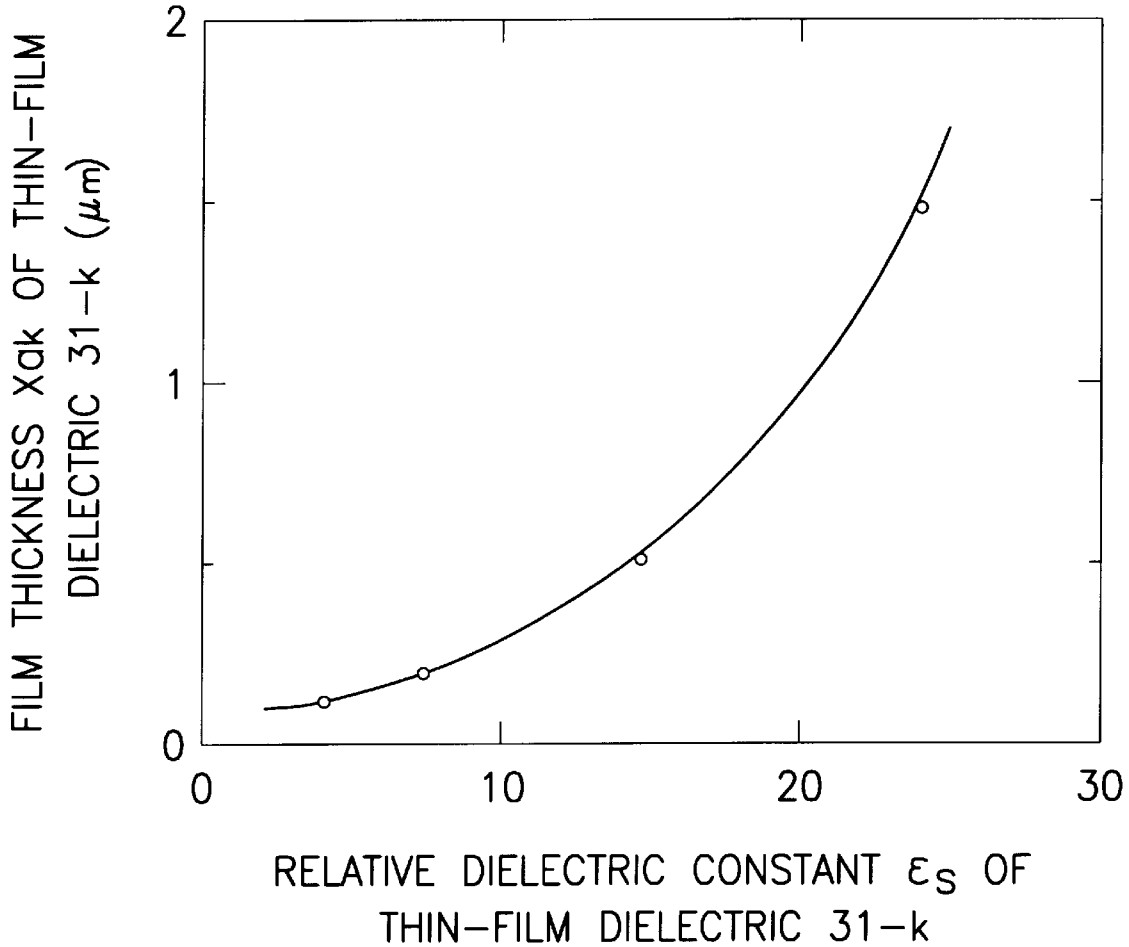
FIG. 5 is a graph showing the thickness xak of the thin-film dielectric 31-k against the relative dielectric constant $\epsilon s$ of the thin-film dielectric 31-k when the electromagnetic field created in the ceramic substrate 10 and the electromagnetic field created in each of the thin-film dielectrics 31-k are substantially in the same phase.

FIG. 5 is a graph showing the film thickness xak of the thin-film dielectric 31-k against the relative dielectric constant $\epsilon s$ of the thin-film dielectrics 31-k where the electromagnetic field created in the ceramic substrate 10 and the electromagnetic field created in the thin-film dielectrics 31-k are substantially in the same phase. Note that the film thickness xak of the thin-film dielectric 31-k is set such that the thin-film dielectrics 31-k have substantially the same phase of electromagnetic field. Based on FIG. 5, if the thin-film dielectric 31-k is formed of $SiO_2$ with a relative dielectric constant of 4, the film thickness xak of the same thin-film dielectric 31-k becomes approximately 0.1 μm. It will be understood that, in order to set the film thickness xak of the thin-film dielectric 31-k to a value within a range of between 0.2 μm and 2.0 μm, there is necessity of setting the relative dielectric constant εs of the thin-film dielectric 30-k to a predetermined value within a range of between 8 and 27.

Figure 6:
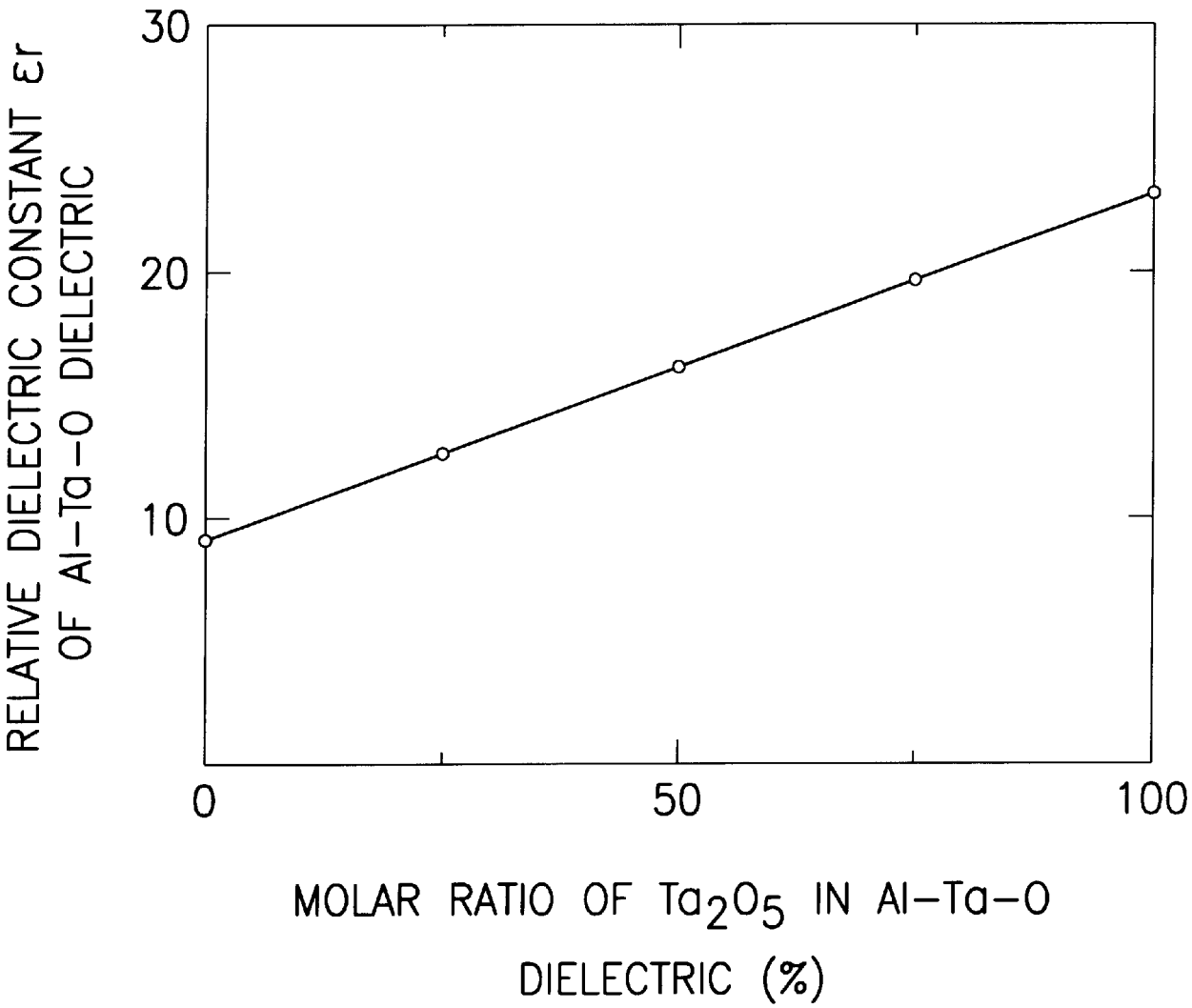
FIG. 6 is a graph showing the relative dielectric constant $\epsilon r$ against the molar ratio of $Ta_2O_5$ in Al—Ta—O dielectric.

In this situation, the present inventors determined that Al—Ta—O dielectric meets the above condition. Note that in the present specification Al—Ta—O dielectric refers to as a material that is comprised of $Al_2O_3$ and $Ta_2O_5$ wherein the relative dielectric constant of the same dielectric material can be varied by varying the composition ratio of $Al_2O_3$ and $Ta_2O_5$. FIG. 6 is a graph showing the relative dielectric constant εr of Al—Ta—O dielectric versus the molar ratio of $Ta_2O_5$ in Al—Ta—O dielectric. As is clear from the graph of FIG. 6, it will be understood that the relative dielectric constant εr of Al—Ta—O dielectric varies almost linearly as the molar ratio of the $Al_2O_3$ and $Ta_2O_5$ varies from 0 to 100%. That is, the relative dielectric constant εr of Al—Ta—O dielectric can be set to a predetermined value between 8 and 23 by varying the molar ratio of the $Al_2O_3$ and $Ta_2O_5$. Consequently, in the second embodiment, the relative dielectric constant εs of the thin-film dielectric 31-k can be set to a predetermined value of between 8 and 23 and the film thickness xak of the thin-film dielectric 31-k can be set to a value between 0.2 μm and 2 μm, by varying the molar ratio of the $Al_2O_3$ and $Ta_2O_5$.

In the second embodiment, since each film thickness xak, xaek of the thin-film dielectric 31-k, E31-k is set to the a same value and each film thickness of the thin-film conductor 11 to 15, E11 to E15 is set to a same value, it is possible to shorten the time required to calculate each film thickness and to simplify the process of forming the thin-film multilayered electrodes 16, E16.

In the TM-mode dielectric resonating apparatus of the second embodiment, the thin-film dielectrics 31-k, E31-k are formed by using Al—Ta—O dielectric so that each film thickness xak, xaek of the thin-film dielectric 30-k, E30-k can be set to a value of between 0.2 μm and 2 μm.

In the TM-mode dielectric resonating apparatus of the second embodiment, since each film thickness xak, xaek of the thin-film dielectric 31-k, E31-k is set to a value between 0.2 μm and 2 μm, short-circuits between the thin-film conductors are prevented so as to reduce the conductor loss in the thin-film multilayered electrodes 16, E16 and to form thin-film multilayered electrodes 16, E16 with great reliability.

In the TM-mode dielectric resonant apparatus of the second embodiment, Al—Ta—O dielectric employed for the thin-film dielectrics 31-k, E31-k has a relative dielectric constant εr which can be set to a predetermined value of between 8 and 23 by varying the composition ratio of $Al_2O_3$ and $Ta_2O_5$. By this, the relative dielectric constant εs of the thin-film dielectrics 31-k, E31-k can be set such that the electromagnetic field created in the ceramic substrate 10 and the electromagnetic field created in the thin-film dielectrics 31-k, E31-k are substantially in phase with each other and the each film thickness xak, Xaek of the thin-film dielectric 31-k, E31-k falls between 0.2 μm and 2 μm.

In the second embodiment, in order to set the film thickness xak, xaek of the thin-film dielectric 31-k, E31-k to a value in a range of between 0.2 μm and 2 μm, the relative dielectric constant εs of the thin-film dielectric 31-k, E31-k may be set to a predetermined value within a range between 8 and 27. Therefore, in the second embodiment, the thin-film dielectric 31-k, E31-k may consist essentially of $Ta_2O_5$ with a relative dielectric constant εr=23.

(Third Embodiment)

The TM-mode dielectric resonant apparatus of a third embodiment is structured similar to the second embodiment shown in FIGS. 4–6, except that, in the second embodiment TM-mode dielectric resonant apparatus, the ceramic substrate 10 is replaced by a ceramic substrate of sintered $MgTiO_3$—$CaTiO_3$—$La_2O_3$, and the Al—Ta—O dielectric is replaced by using MgO—$SiO_2$ dielectric to form the dielectrics 31-k, E31-k. Note that the relative dielectric constant of the ceramic substrate formed by the $MgTiO_3$—$CaTiO_3$—$La_2O_3$ sintered body is 21. In this case, to set the film thickness xak, xaek of the thin-film dielectric 31-k, E31-k to a value of between 0.2 μm and 2 μm similarly to the second embodiment, the relative dielectric constant εs of the thin-film dielectric 31-k, E31-k has to be set to a predetermined value of between 4 and 15. On the other hand, the relative dielectric constant of MgO—$SiO_2$ dielectric can be varied between 4 and 8 by varying the composition ratio of MgO and $SiO_2$. For example, if MgO:$SiO_2$=1:1, the relative dielectric constant of MgO—$SiO_2$ dielectric becomes 5, whereas if MgO:$SiO_2$=3:1, the relative dielectric constant of the MgO-$SiO_2$ dielectric becomes 7. Therefore, the film thickness xak, xaek of the thin-film dielectric 31-k, E31-k can be set to a value of between 0.2 μm and 2 μm by using the $MgTiO_3CaTiO_3$—$LaO_3$ sintered body as a ceramic substrate 10, forming the thin-film dielectric 31-k, E31-k utilizing the MgO—$SiO_2$ dielectric, and varying the composition ratio of MgO and $SiO_2$. In the third embodiment, the thin-film dielectrics 31-k, E31-k may consist essentially of $SiO_2$ with a relative dielectric constant εr=4.

In the third embodiment as described above, to set the film thickness xak, xaek of the thin-film dielectric 31-k, E31-k to a value of between 0.2 μm and 2 μm, the relative dielectric constant εs of the thin-film dielectric 31-k, E31-k may be a value of between 4 and 15. Therefore, in the third embodiment, the thin-film dielectric 31-k, E31-k may consist essentially of MgO with a relative dielectric constant εr of 8 or $SiO_2$ with a relative dielectric constant εr of 4. It may otherwise be formed of $Si_3N_4$ with a relative dielectric constant of approximately 7.

(Fourth Embodiment)

Figure 7:
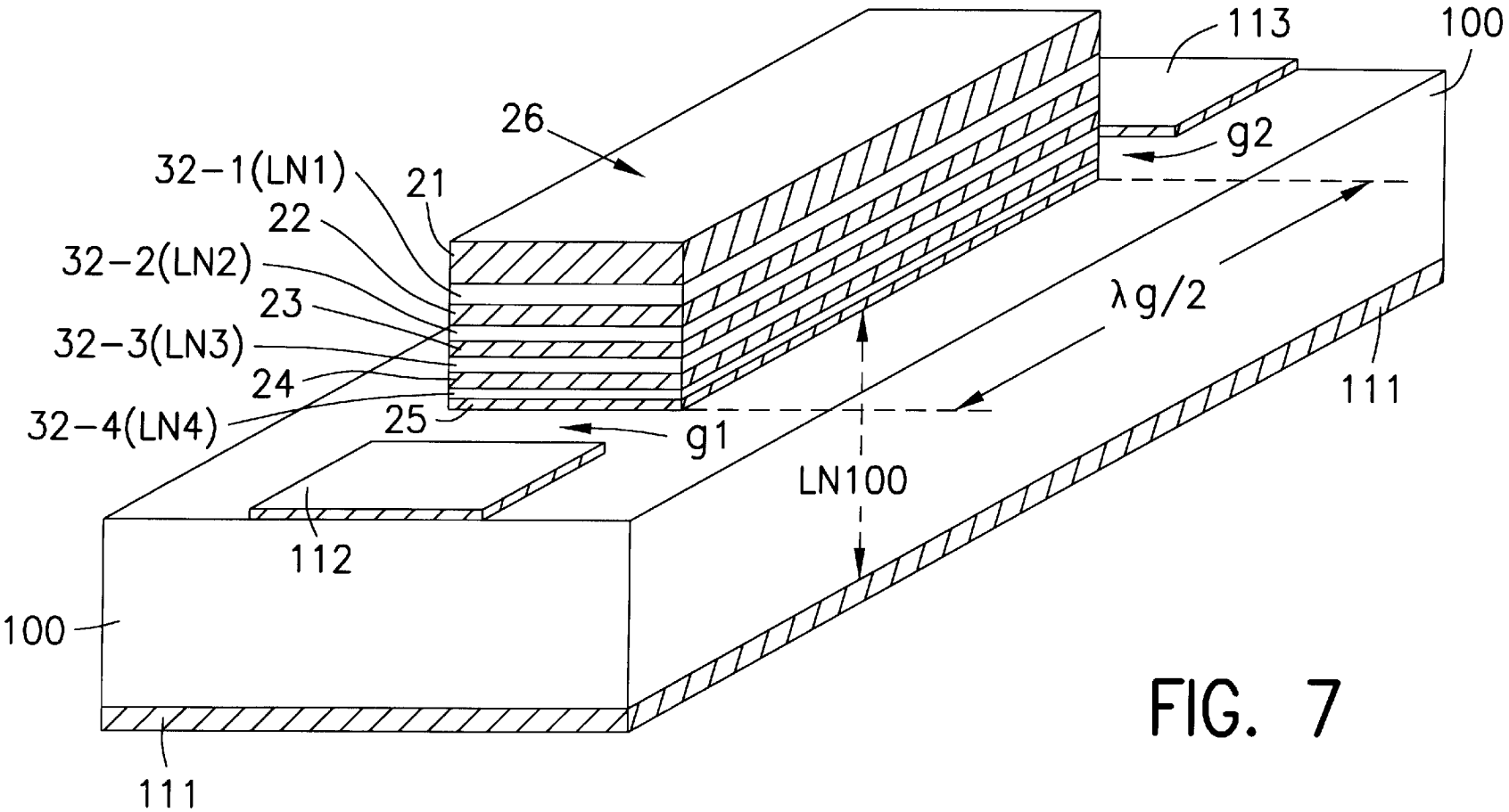
FIG. 7 is a perspective view of a filter using a ½-wavelength line-type resonator of a fourth embodiment according to the present invention.

FIG. 7 is a perspective view of a filter using a ½-wavelength line-type resonator of a fourth embodiment according to the present invention.

The ½-wavelength line-type resonator of the fourth embodiment is characterized by using an electromagnetic field coupling type thin-film-layered transmission line employing a thin-film multilayered electrode 26 having alternately layered thin-film conductors 21 to 25 and thin-film dielectrics 32-1 to 32-4. In this electromagnetic field coupling type thin-film-layered transmission line, a thin-film multilayered electrode 26 is formed on a ceramic substrate 100, which substrate has a ground conductor 111 formed on the opposite side thereof such that the lowermost layered thin-film conductor 25 is in contact with the top surface of the ceramic substrate 100. By doing so, a TEM-mode micro-strip line (hereinafter called the main transmission line) LN100 is structured by the thin-film conductor 25, the ground conductor 111, and the ceramic substrate 100 sandwiched between the thin-film conductor 25 and the ground conductor 111. On the other hand, four micro-strip lines (hereinafter called the sub-transmission lines) LN1 to LN4 are layered on the main transmission line LN100, each of which has one thin-film dielectric sandwiched between a pair of thin-film conductors. In FIG. 7, reference characters for the sub-transmission lines are given in parentheses corresponding to respective thin-film dielectrics of the sub-transmission lines.

More particularly, the strip-shaped thin-film conductor 25 with a lengthwise length of $\lambda g/2$ ($\lambda g$ is a guide wavelength) is formed on the ceramic substrate 100, which has the ground conductor 111 formed over the entire opposite side as shown in FIG. 7. Note that the main transmission line LN100 is structured by the thin-film conductor 25, the ground conductor 111, the ceramic substrate 100 sandwiched between the thin-film conductor 25 and the ground conductor 111. Subsequently, a thin-film dielectric 32-4, a thin-film conductor 24, a thin-film dielectric 32-3, a thin-film conductor 23, a thin-film dielectric 32-2, a thin-film conductor 22, a thin-film dielectric 32-1, and a thin-film conductor 21 are formed on the thin-film conductor 25. This provides the structure of the sub-transmission lines LN1 to LN4, wherein:

(a) The sub-transmission line L1 is structured by sandwiching the thin-film dielectric 32-1 between a pair of the thin-film conductors 21 and the thin-film conductor 22.

(b) The sub-transmission line L2 is structured by sandwiching the thin-film dielectric 32-2 between a pair of the thin-film conductors 22 and the thin-film conductor 23.

(c) The sub-transmission line L3 is structured by sandwiching the thin-film dielectric 32-3 between a pair of the thin-film conductors 23 and the thin-film conductor 24.

(d) The sub-transmission line L4 is structured by sandwiching the thin-film dielectric 32-4 between a pair of the thin-film conductors 24 and the thin-film conductor 25.

More particularly:

(a) The film thickness and the relative dielectric constant $\epsilon s$ of each of the thin-film dielectrics 32-1 to 32-4 are set such that the TEM-waves propagating respectively through the main transmission line LN100 and each of the sub-transmission lines LN1 to LN4 are coincident in phase velocity with one another and the thin-film thickness of the thin-film dielectrics 32-1 to 32-4 are set to values of between 0.2 $\mu$m and 2 $\mu$m.

(b) Each conductor film thickness of the thin-film conductor 22 to 25 is set to such a predetermined value that is thinner than the skin depth $\delta 0$ at the service frequency and becomes thicker, the higher the layer is located.

(c) The conductor film thickness of the thin-film conductor 21 is set such that it equals $\pi/2$ times the skin depth $\delta 0$ at the service frequency at which thickness the total loss of the conductor loss and the radiation loss in the conductor 21 is minimized.

Furthermore, an input terminal conductor 112 is formed on the ceramic substrate 100 so that it is separated by a predetermined gap g1 from one end of the thin-film conductor 25 but is close enough thereto for electromagnetic coupling, while an output terminal conductor 113 is formed on the ceramic substrate 100 so that it is separated by a predetermined gap g2 from the other end of the thin-film conductor 25 but is close enough thereto for electromagnetic coupling. The coupling between the input terminal conductor 112 and the output terminal conductor 113 and the respective ends of the thin-film conductor 25 is capacitive coupling.

In the ½-wavelength line-type resonator constructed as above, when the main transmission line LN100 is excited by a high-frequency signal, the lowermost layered thin-film conductor 25 allows part of the energy of the high-frequency signal to transmit to the next thin-film conductor 24. The thin-film conductors 21 to 24 respectively transmit part of the high-frequency electrical power incident in a lower thin-film conductor to a higher thin-film conductor, and reflect part of the high-frequency signal toward the lower thin-film conductor through the lower thin-film conductor. Within each of the thin-film dielectrics 32-1 to 32-4 sandwiched between the two adjacent thin-film conductors, the reflected wave and the transmitted wave are in resonance, and each of the thin-film conductors 21 to 25 have two opposite, facing high-frequency currents (hereinafter referred to as the two high-frequency currents) flowing respectively nearby the upper surface and the lower surface thereof. That is, each of the thin-film conductors 22 to 25 has a film thickness thinner than the skin depth $\delta 0$ so that the facing two high-frequency currents are in interference and they are offset with other part thereof left. Meanwhile, each of the thin-film dielectrics 32-1 to 32-4 has a displacement current created by the electromagnetic field, causing high-frequency currents in the surface of the adjacent thin-film conductors. Furthermore, each of the film thicknesses of the thin-film dielectric 32-1 to 32-4 is configured so as to bring the phase velocity of the TEM waves propagating respectively through the main transmission line LN100 and the sub-transmission lines LN1 to LN4 substantially into coincidence with one another, so that the high-frequency currents respectively flowing in the thin-film conductors 21 to 25 are substantially in phase with one another. By doing so, the high-frequency currents flowing in the same phase in the thin-film conductors 21 to 25 effectively serve to increase the skin depth.

Consequently, if the ½-wavelength line type resonator is excited by a high-frequency signal, the energy of the high-frequency electromagnetic field is transferred to an upper transmission line by the electromagnetic field coupling of the adjacent transmission lines while being propagated in the lengthwise direction of the same resonator. On this occasion, the same resonator effectively possesses a greater skin depth $\delta 0$ or in other words a smaller surface resistance $\epsilon s$ so that the TEM wave propagates to be reflected by the opposite ends of the ½-wavelength line-type resonator, thereby entering a resonant state.

Note that the ceramic substrate 100 is formed of (Zr, Sn)$TiO_4$ similarly to the first and second embodiments. Also, each film thickness of the thin-film dielectric 32-k is set to a value of between 0.2 $\mu$m and 2 $\mu$m, by using Ta—Si—O as in the first embodiment or Al—Ta—O as in the second embodiment.

The ½-wavelength line-type resonator of the fourth embodiment constructed as above is provided with a thin-film multilayered electrode 26, hence possessing high unloaded Q.

(Modifications)

Although in the first, second, and fourth embodiments as above a ceramic substrate 10, 100 of (Zr, Sn)$TiO_4$ was employed, the present invention is not limited to this. It may be based on (Zr, Sn)$TiO_4$ and also contain, e.g., additive agents serving for accelerating sintering or lowering sintering temperature during sintering. Even with these additives, the operation is similar to the first, second, and fourth embodiments and has similar effects.

Although the above first to fourth embodiments employed a ceramic substrate 10, 100 of (Zr, Sn)$TiO_4$ or a ceramic substrate of a $MgTiO_3$—$CaTiO_3$—$La_2O_3$ sintered body, the present invention is not limited to those, e.g., other ceramic substrates such as BaO—PbO—$Nd_2O_3$—$TiO_2$ may be used, with similar results.

Also, in the first to fourth embodiments, the thin-film dielectrics 30-k, E30-k, 31-k, E31-k, 32-K were formed by using Ta—Si—O dielectric, Al—Ta—O dielectric, or MgO—$SiO_2$ mixture dielectric. However, the present invention is not limited to those, and other dielectric materials such as, e.g., $Si_3N_4$—$SiO_2$, by which the film thickness of the thin-film dielectric can be set within a range of from 0.2 $\mu$m to 2 $\mu$m, may be used, with similar results.

Although the above first to third embodiments were each structured with one TM-mode dielectric resonator R1, R2, the present invention is not limited to this and it may be provided with two or more TM-mode dielectric resonators to form a filter, with similar results.

Although in the fourth embodiment the ½-wavelength line-type resonator was structured by using the thin-film multilayered electrode 26, the present invention is not limited to this and the transmission line may be structured with relatively strong electromagnetic coupling between the input transmission line, the output transmission line, and the electromagnetic field coupling type thin-film-layered transmission line. With such a structure, it is possible to utilize the electromagnetic field coupling type thin-film-layered transmission line with much reduced losses.

Furthermore, although in the fourth embodiment the main transmission line LN100 is a TEM mode transmission line, the present invention is not limited to this and the main transmission line LN100 may be a transmission line for propagating electromagnetic waves of the TE mode or the TM mode.

EXAMPLES

First Example

A first example is explained, wherein a TM-mode dielectric resonator R1 of the first embodiment has been manufactured on an experimental basis and evaluated. The film thicknesses in the thin-film multilayered electrode 6, E6 are set out below.

(a) Film thickness xa1, Xae1=0.89 $\mu$m for thin-film dielectric 30-1, E30-1

(b) Film thickness xa2, Xae2=0.62 $\mu$m for thin-film dielectric 30-2, E30-2

(c) Film thickness xa3, Xae3=0.51 $\mu$m for thin-film dielectric 30-3, E30-3

(d) Film thickness xa4, Xae4=0.45 $\mu$m for thin-film dielectric 30-4, E30-4

(e) Conductor film thickness=2.6 $\mu$m for thin-film conductor 1, E1

(f) Conductor film thickness=1.2 $\mu$m for thin-film conductor 2, E2

(g) Conductor film thickness=0.91 $\mu$m for thin-film conductor 3, E3

(h) Conductor film thickness=0.77 $\mu$m for thin-film conductor 4, E4

(i) Conductor film thickness=0.68 $\mu$m for thin-film conductor 5, E5

Also, the radius r1 of the thin-film multilayered electrode 6, E6 was set at 15.0 mm, and the resonant frequency f0 of the TM-mode dielectric resonator R1 was set at 1900 MHz, which is different from the frequency of 950 MHz described in the first embodiment.

Note that the thin-film dielectrics 30-k, E30-k of Ta—Si—O dielectric were formed with $Ta_2O_5$:$SiO_2$=1:1 as described below. Firstly, a sputter target is prepared by blending $Ta_2O_5$ and $SiO_2$ in a mixing ratio of 1:1 and thereafter forming into a cylindrical shape and then sintering at a predetermined temperature. Using this sputter target, thin-film dielectrics 30-k, E30-k are formed through the sputtering technique. Also, thin-film conductors 1 to 5, E1 to E5 are formed by using a Cu sputter target through the sputtering method. Table 1 shows the increase rate of unloaded Q of the TM-mode dielectric resonator R1 thus fabricated as well as the film-forming time period for the thin-film dielectric 30-k. Note that the increase rate of unloaded Q of the TM-mode dielectric resonator R1 is calculated by using as a reference the unloaded Q for the TM-mode dielectric resonator having a single-layered Cu conductor film with a thickness of 3 times the skin depth for the above resonant frequency, instead of the thin-film multilayered electrode 6, E6. The film-forming time period is represented by the time period in which the upper first thin-film dielectric 30-1 is formed. Incidentally, there are also shown in Table 1 the increase rate of unloaded Q and the film-forming time period when the thin-film dielectrics 30-k, E30-k are formed by using $Ta_2O_5$, and by using $SiO_2$, for comparative purposes.

TABLE 1

| Material for thin-film 30-K, E30-K | Q increase dielectrics rate | Film-forming time period |
|---|---|---|
| Ta—Si—O dielectric | 2.1 | 150 minutes |
| $Ta_2O_5$ dielectric | 2.1 | 270 minutes |
| $SiO_2$ dielectric | 1.4 | 40 minutes |

As is clear from Table 1, when a TM-mode dielectric resonator R1 is structured by using Ta—Si—O dielectric to form the thin-film dielectrics 30-k, E30-k, the increase rate of unloaded Q is equivalent, but the film-forming time period can be shortened, as compared with the case of forming the thin-film dielectrics 30-k, E30-k using $Ta_2O_5$. Also, with Ta—Si—O, the film-forming time period is rendered longer but the increase rate of unloaded Q can be raised higher, as compared with the case of forming the thin-film dielectric 30-k, E30-k using $SiO_2$. This is because the formation of the thin-film dielectrics 30-k, E30-k using $Ta_2O_5$ requires a thicker film thickness xak, as stated in the explanation of the first embodiment. It is further presumed that, when the thin-film dielectric 30-k is formed using $SiO_2$, short-circuits occur between the adjacent thin-film conductors k, k+1 through the thin-film dielectric 30-k.

Second Example

A second example is explained, wherein a TM-mode dielectric resonator R2 of the second embodiment has been manufactured on an experimental basis and evaluated. In the second example, the film thickness for the thin-film dielectrics 31-k, E31-k and the thin-film conductors 11 to 15 were set in the following manner. Note that in the second example each film thickness xak, xaek of the thin-film dielectrics 31-k, E31-k is set at a same value, and each conductor film thickness of the thin-film conductors 11 to 15 is set at a same value.

(a) Film thickness xak, Xaek=1.0 $\mu$m for thin-film dielectric 31-k, E31-k (b) Film thickness=0.76 μm for thin-film conductor 11 to 15

Also, the radius r2 of the thin-film multilayered electrode 16 was set at 11.0 mm, and the resonant frequency f0 for the TM-mode dielectric resonator R2 was set at 2.6 GHz.

Note that the thin-film dielectrics 31-k, E31-k were formed of Al—Ta—O dielectric wherein Ta—$O_5$:$Al_2O_3$=3:1, similarly to the first example, as described below. Firstly, a sputter target is prepared by blending $Ta_2O_5$ and $Al_2O_3$ in a mixing ratio of 3:1 and thereafter forming into a cylindrical shape and then sintering at a predetermined temperature. Using this sputter target, thin-film dielectrics 31-k, E31-k are formed through the sputter technique. Also, thin-film conductors 1 to 5 are formed of Ti/Cu, as described below.

Firstly, a Ti film is formed by the sputter method over the surface of a ceramic substrate 10 to a thickness greater than 20 nm, preferably approximately 40 nm. Then a Cu film is formed to a predetermined film thickness over the surface of the Ti film, thereby forming a thin-film conductor 5 of the Ti and Cu films. After forming a thin-film dielectric 31-4, a Ti film is formed by the sputter method over the surface of the thin-film dielectric 31-4 to a thickness greater than 20 nm, preferably approximately 40 nm such that the Cu film is formed to a predetermined film thickness over the Ti film, thereby forming a Ti—and—Cu thin-film conductor 4. Thereafter thin-film conductors 1, 2, and 3 are formed in the similar manner. In the second example, the ceramic substrate 10 and the thin-film dielectric 31-k can be firmly adhered to the Cu film by the Ti film. Further, thin-film conductors E1 to E5 are formed likewise for a thin-film multilayered electrode E16.

Table 2 shows the increase rate of unloaded Q of the TM-mode dielectric resonator R2 of the second example thus fabricated as well as the film-forming time period for the thin-film dielectric 31-k, E31-k. Note that the increase rate of unloaded Q of the TM-mode dielectric resonator R2 is calculated by using as a reference the unloaded Q for the TM-mode dielectric resonator having a single-layered Cu conductor film with a thickness of 3 times the skin depth for the above resonant frequency, instead of the thin-film multilayered electrode 16, E16. The film-forming time period is represented by the time period in which the thin-film dielectric 31-k, E31-k is formed. Also shown in Table 2 are the increase rate of unloaded Q and the film-forming time period in the case of forming the thin-film dielectrics 31-k, E31-k using $Ta_2O_5$ and in the case of forming the thin-film dielectrics 31-k, E31-k using $SiO_2$, for comparison purposes.

TABLE 2

| Material for thin-film 30-K, E30-K | Q increase dielectrics rate | Film-forming time period |
|---|---|---|
| Al—Ta—O dielectric | 1.8 | 120 minutes |
| $Ta_2O_5$ dielectric | 1.8 | 210 minutes |
| $SiO_2$ dielectric | 1.2 | 30 minutes |

As is clear from Table 2, in the case where a TM-mode dielectric resonator R2 is structured by using Al—Ta—O dielectric to form the thin-film dielectrics 31-k, E31-k, the increase rate of unloaded Q is equivalent, but the film-forming time period can be shortened, as compared with the case of forming the thin-film dielectrics 31-k, E31-k using $Ta_2O_5$. Further, the film-forming time period is rendered longer but the increase rate of unloaded Q can be raised higher as compared with the case of forming the thin-film dielectrics 31-k, E31-k using $SiO_2$.

The unloaded Q increase rate for the second embodiment TM-mode dielectric resonator R2 is rather low as compared with the first embodiment TM-mode dielectric resonator R1. This is because, in the thin-film multilayered electrode 16, E16, the film thickness xak, xaek and the conductor film thickness are set such that the electromagnetic field created in the ceramic substrate 10 and the electromagnetic field created in each thin-film dielectric 31-k, E31-k are substantially in phase with one another, under the condition that the film thickness xak, xaek of the thin-film dielectrics 31-k, E31-k are of the same value and the conductor film thickness of the thin-film conductors 11 to 15 are of the same value, as stated before. The thin-film multilayered electrode 16, E16 constructed as above represents sufficient decrease in conductor loss as compared, e.g., with a single-layered conductor with a thickness sufficiently greater than the skin depth, while the conductor loss thereof is somewhat greater as compared with the first example thin-film multilayered electrode 6, E6, as stated before in explaining the second embodiment.

What is claimed is:

1. A thin-film multilayered electrode provided on a dielectric substrate, the dielectric substrate having a predetermined dielectric constant, the thin-film multilayered electrode comprising:

plurality of thin-film conductors and a plurality of thin-film dielectrics alternately stacked on the dielectric substrate; wherein each of the thin-film dielectrics has a dielectric constant such that when the thin-film multilayered electrode is used at a predetermined frequency, an electromagnetic field created in the dielectric substrate and an electromagnetic field created in each of the thin-film dielectrics have substantially the same phase;

wherein each of the thin-film dielectrics has a thickness in the range of 0.2 to 2 μm; and wherein each of the thin-film conductors other than an outermost one of the thin-film conductors located farthest from the dielectric substrate has a thickness smaller than a skin depth at said predetermined frequency, and said outermost thin-film conductor has a thickness greater than said skin depth at said predetermined frequency.

2. A thin-film multilayered electrode according to claim 1, wherein at least one of said thin-film dielectrics contains at least one of $Al_2O_3$, $Ta_2O_5$, $SiO_2$, $Si_3N_4$, and MgO.

3. A thin-film multilayered electrode according to claim 2, wherein at least one of said thin-film dielectrics contains $Ta_2O_5$ and $SiO_2$, whereby the dielectric constant of said thin-film dielectrics is a function of the ratio of the $Ta_2O_5$ and the $SiO_2$.

4. A thin-film multilayered electrode according to claim 2, wherein at least one of said thin-film dielectrics contains $Ta_2O_5$ and $Al_2O_3$, whereby the dielectric constant of said thin-film dielectrics is a function of the ratio of the $Ta_2O_5$ and the $Al_2O_3$.

5. A thin-film multilayered electrode according to claim 2, wherein at least one of said thin-film dielectrics contains MgO and $SiO_2$, whereby the dielectric constant of said thin-film dielectrics is a function of the ratio of the MgO and the $SiO_2$.

6. A thin-film multilayered electrode according to claim 2, 3, 4, 5 or 1, wherein said thin-film conductors and thin-film dielectrics in said thin-film multilayered electrode comprise heat-treated conductive and dielectric material, and said dielectric substrate is a sintered dielectric ceramic substrate.

7. A thin-film multilayered electrode according to claim 6, wherein said dielectric ceramic of said dielectric substrate is based on $(Zr, Sn)TiO_4$.

8. A high-frequency resonator comprising:

a thin-film multilayered electrode provided on a dielectric substrate according to claim 2, 3, 4, 5 or 1; and a second electrode provided on an opposite side of said dielectric substrate from said thin-film multilayered electrode such that said thin-film multilayered electrode and said second electrode sandwich said dielectric substrate.

9. A high-frequency resonator according to claim 8, wherein said second electrode is a thin-film multilayered electrode.

10. A high-frequency resonator according to claim 9, wherein said thin-film multilayered electrode and said second electrode have substantially a same round cross-sectional shape.

11. A high-frequency transmission line comprising:

a thin-film multilayered electrode provided on a dielectric substrate according to claim 2, 3, 4, 5 or 1; and a second electrode provided on an opposite side of said dielectric substrate from said thin-film multilayered electrode such that said thin-film multilayered electrode and said second electrode sandwich said dielectric substrate.

12. A high-frequency transmission line according to claim 11, wherein said second electrode is a thin-film multilayered electrode.

13. A high-frequency transmission line according to claim 12, wherein said thin-film multilayered electrode and said second electrode have substantially a same elongated cross-sectional shape.

* * * * *